US009719631B1

(12) United States Patent
DeLoach, Jr. et al.

(10) Patent No.: US 9,719,631 B1
(45) Date of Patent: Aug. 1, 2017

(54) UNIVERSAL HELMET MOUNT ASSEMBLY

(71) Applicants: Thomas W. DeLoach, Jr., New Hill, NC (US); Kevin E. Flynn, Pittsboro, NC (US)

(72) Inventors: Thomas W. DeLoach, Jr., New Hill, NC (US); Kevin E. Flynn, Pittsboro, NC (US)

(73) Assignee: Thomas W. DeLoach, Jr., New Hill, NC (US)

( * ) Notice: Subject to any disclaimer, the term of this patent is extended or adjusted under 35 U.S.C. 154(b) by 0 days.

(21) Appl. No.: 15/222,065

(22) Filed: Jul. 28, 2016

Related U.S. Application Data

(60) Provisional application No. 62/198,090, filed on Jul. 28, 2015.

(51) Int. Cl.

| | |
|---|---|
| ***A47F 5/00*** | (2006.01) |
| ***F16M 13/02*** | (2006.01) |
| ***A63B 71/10*** | (2006.01) |
| ***F16B 2/06*** | (2006.01) |

(52) U.S. Cl.
CPC ..... *F16M 13/02* (2013.01); *A63B 71/10* (2013.01); *F16B 2/065* (2013.01)

(58) Field of Classification Search
CPC .. A47G 25/10; A47G 1/12; A47F 7/06; A47F 5/0807; A47F 7/00
See application file for complete search history.

(56) References Cited

U.S. PATENT DOCUMENTS

| | | | | |
|---|---|---|---|---|
| 4,684,096 | A * | 8/1987 | Tanaka | A42B 3/006 211/32 |
| 6,170,185 | B1 * | 1/2001 | Donofrio, Jr. | A47G 25/10 211/30 |
| 7,555,860 | B1 * | 7/2009 | Ivanitch | A47F 5/0807 40/657 |
| D647,710 | S * | 11/2011 | Anderson | A47F 7/06 D6/327 |
| 9,119,485 | B1 | 9/2015 | DeLoach, Jr. | |
| 9,149,133 | B1 | 10/2015 | DeLoach, Jr. | |
| 9,320,371 | B2 | 4/2016 | DeLoach, Jr. | |

OTHER PUBLICATIONS

Museum Hanging Systems.net Web page as stored by Archive.Org at http://web.archive.org/web/20150318000253/http://museumhangingsystems.net/, capture date per Archive.Org is Mar. 18, 2015, 5 pages as printed, Museum Hanging Systems, Columbia, NJ, USA.

(Continued)

*Primary Examiner* — Amy Sterling
(74) *Attorney, Agent, or Firm* — Kevin E Flynn; Flynn IP Law

(57) ABSTRACT

A wall mount assembly for suspending a helmet near a wall to provide the illusion to a viewer positioned so that the helmet is located between the viewer and the wall mount base that the helmet is floating without support. The wall mount assembly having at least one wall mount pad that may be moved relative to a wall side of the wall mount base to alter a tilt of the helmet relative to the wall side of the wall mount base. A helmet threaded element extending from the wall mount base and through a hole in the helmet receives an interior threaded element which may be advanced to secure the helmet to the wall mount base.

11 Claims, 4 Drawing Sheets

(56) References Cited

OTHER PUBLICATIONS

Wall Mounted Football Helmet Display Case as stored by Archive.Org at https://web.archive.org/web/20130212062123/http://www.perfectcases.com/Rectangle_Football_Helmet_Display_Case_p/fbhr.htm, capture date per Archive.Org is Feb. 12, 2013, 1 page, Perfect Cases, Inc., Sorrento, FL USA.

Ball & Helmet Holders home page as stored by Archive.Org at https://web.archive.org/web/20150203102155/http://ballandhelmetholder.com/isapi/isapi.dll?page&home, capture date per Archive.Org is Feb. 3, 2015, 2 pages, Ball and Helmet Holders, LLC, Derby, CT, USA.

* cited by examiner

FIG. 4 1000

| | |
|---|---|
| 1010 | Obtain a Helmet to be Displayed |
| 1020 | Select the Location on the Wall |
| 1030 | Install Wall Mount Fasteners |
| 1040 | OPTIONAL - Adjust Wall Mount Pads |
| 1050 | Engage Wall Mount Base with Wall Mount Fasteners |
| 1060 | Insert Threaded Element Through Helmet Opening |
| 1070 | Check Helmet Tilt on Wall Mount Pads |
| 1080 | OPTIONAL - Adjust Wall Mount Pads |
| 1090 | Engage Pad with the Helmet Threaded Element |
| 1100 | Advance the Interior Threaded Element |

FIG. 5

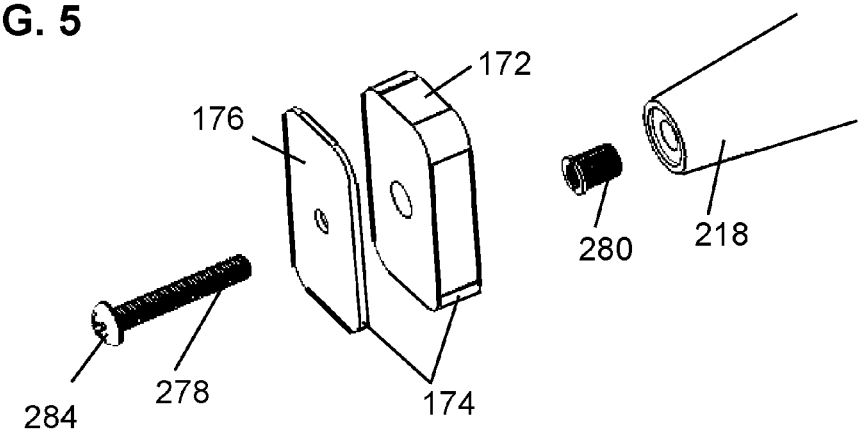

UNIVERSAL HELMET MOUNT ASSEMBLY

This application claims the benefit of U.S. Provisional Patent Application No. 62/198,090 filed Jul. 28, 2015 for Universal Helmet Mount Assembly. The contents of the '090 application are incorporated by reference in its entirety.

BACKGROUND

Field of the Disclosure

This disclosure relates generally to assemblies that allow for the mounting for display of a helmet such as a football helmet. Non-limiting examples of other helmets that may be displayed include baseball helmets, softball helmets, lacrosse helmets, and certain hockey helmets including goalie masks. The assembly may be connected to a flat surface such as a vertical wall, slanted wall, or ceiling.

SUMMARY OF THE DISCLOSURE

Some of the teachings of the present disclosure may be summarized as a helmet mount assembly for holding a helmet in a fixed relationship relative to a wall mount base, the helmet mount assembly comprising: the wall mount base; a pad; and an interior threaded element.

The wall mount base having: a set of at least two wall mount pads which resist movement of the helmet towards the wall mount base, at least one of the set of at least two wall mount pads being adjustable to alter a distance between a helmet side of the wall mount pad and a wall side of the wall mount base. The wall mount base having a helmet threaded element that protrudes from the wall mount base away from the wall side of the wall mount base. The pad having a bore to receive the helmet threaded element.

Such that placing a helmet such that the helmet threaded element extends into a helmet primary cavity through an opening in the helmet allows the bore of the pad to be placed over the helmet threaded element; and advancing the interior threaded element holds the helmet between the pad and the set of at least two wall mount pads to display the helmet at a selected tilt with respect to the wall mount base.

Other teachings of the present disclosure may be summarized as a method to display a helmet on a wall, the method requiring obtaining a helmet to be displayed, the helmet having a helmet primary cavity for receipt of a user's head and at least one helmet opening.

The method also requiring obtaining a wall mount base with: a wall side intended to be placed against a wall location to receive the wall mount base; a helmet side intended for interaction with a helmet; a helmet threaded element extending from the wall mount base away from the wall side of the wall mount base, the helmet threaded element to be inserted through the opening in the helmet; and a set of at least two wall mount pads with at least one of the set of at least two wall mount pads being adjustable so that a distance between a helmet side of the wall mount pad may be moved relative to the wall side of the wall mount base in order to adjust a tilt of a helmet engaged with the wall mount base.

The method requiring adjusting the set of at least two wall mount pads to provide a particular tilt of a helmet relative to the wall mount base; and engaging the helmet with the wall mount base by advancing an interior threaded element from the helmet primary cavity onto a helmet side end of the helmet threaded element extended into the helmet primary cavity through the opening in the helmet, the advancing continuing until the helmet is pressed against the set of at least two wall mount pads.

While some teachings of the present disclosure use an interior threaded element that is a female threaded element such as a wingnut, other teachings of the present disclosure use an interior threaded element that is a male threaded element to engage with a female helmet threaded element in the wall mount base. Thus the teachings of the present disclosure may be summarized as a helmet mount assembly for holding a helmet in a fixed relationship relative to a wall mount base, the helmet mount assembly comprising: the wall mount base; a pad; and an interior threaded element. The wall mount base comprising: a set of at least two wall mount pads which resist movement of the helmet towards the wall mount base, at least one of the set of at least two wall mount pads being adjustable to alter a distance between a helmet side of the wall mount pad and a wall side of the wall mount base; and a female helmet threaded element open on a helmet side of the wall mount base to engage the interior threaded element.

The helmet mount assembly pad having a bore to receive the interior threaded element. Such that placing a helmet such that the interior threaded element extends through a bore in the pad and from a helmet primary cavity through an opening in the helmet; and advancing the interior threaded element into the female helmet threaded element holds the helmet between the pad and the set of at least two wall mount pads to display the helmet at a selected tilt with respect to the wall mount base.

The teachings of the present disclosure may also be summarized as a method to display a helmet on a wall, the method including obtaining a helmet to be displayed, the helmet having a helmet primary cavity for receipt of a user's head and at least one helmet opening. The method also including obtaining a wall mount base, the wall mount base having a wall side intended to be placed against a wall location to receive the wall mount base; a helmet side intended for interaction with a helmet; a female helmet threaded element with an open threaded bore facing away from the wall side of the wall mount base, the female helmet threaded element to receive an interior threaded element inserted through the opening in the helmet; and a set of at least two wall mount pads with at least one of the set of at least two wall mount pads being adjustable so that a distance between a helmet side of the wall mount pad may be moved relative to the wall side of the wall mount base in order to adjust a tilt of a helmet engaged with the wall mount base.

The method including adjusting the set of at least two wall mount pads to provide a particular tilt of a helmet relative to the wall mount base; and engaging the helmet with the wall mount base by advancing the interior threaded element from the helmet primary cavity and through the helmet opening into the open threaded bore of the female helmet threaded element, the advancing of the interior threaded element continuing until the helmet is pressed against the set of at least two wall mount pads.

Inventive concepts are illustrated in a series of examples, some examples showing more than one inventive concept. Individual inventive concepts can be implemented without implementing all details provided in a particular example. It is not necessary to provide examples of every possible combination of the inventive concepts provide below as one of skill in the art will recognize that inventive concepts illustrated in various examples can be combined together in order to address a specific application.

Other systems, methods, features and advantages of the disclosed teachings will be immediately apparent or will become apparent to one with skill in the art upon examination of the following figures and detailed description. It is intended that all such additional systems, methods, features and advantages be included within the scope of and be protected by the accompanying claims.

BRIEF DESCRIPTION OF THE FIGURES

The disclosure can be better understood with reference to the following figures. The components in the figures are not necessarily to scale, emphasis instead being placed upon illustrating the principles of the disclosure. Moreover, in the figures, like reference numerals designate corresponding parts throughout the different views.

FIG. 4 is a flowchart of one process to mount a helmet to a wall.

FIG. 5 shows the components for use of a male interior threaded element to press the pad against the interior of the helmet (helmet not shown).

DETAILED DESCRIPTION

Figure 1:
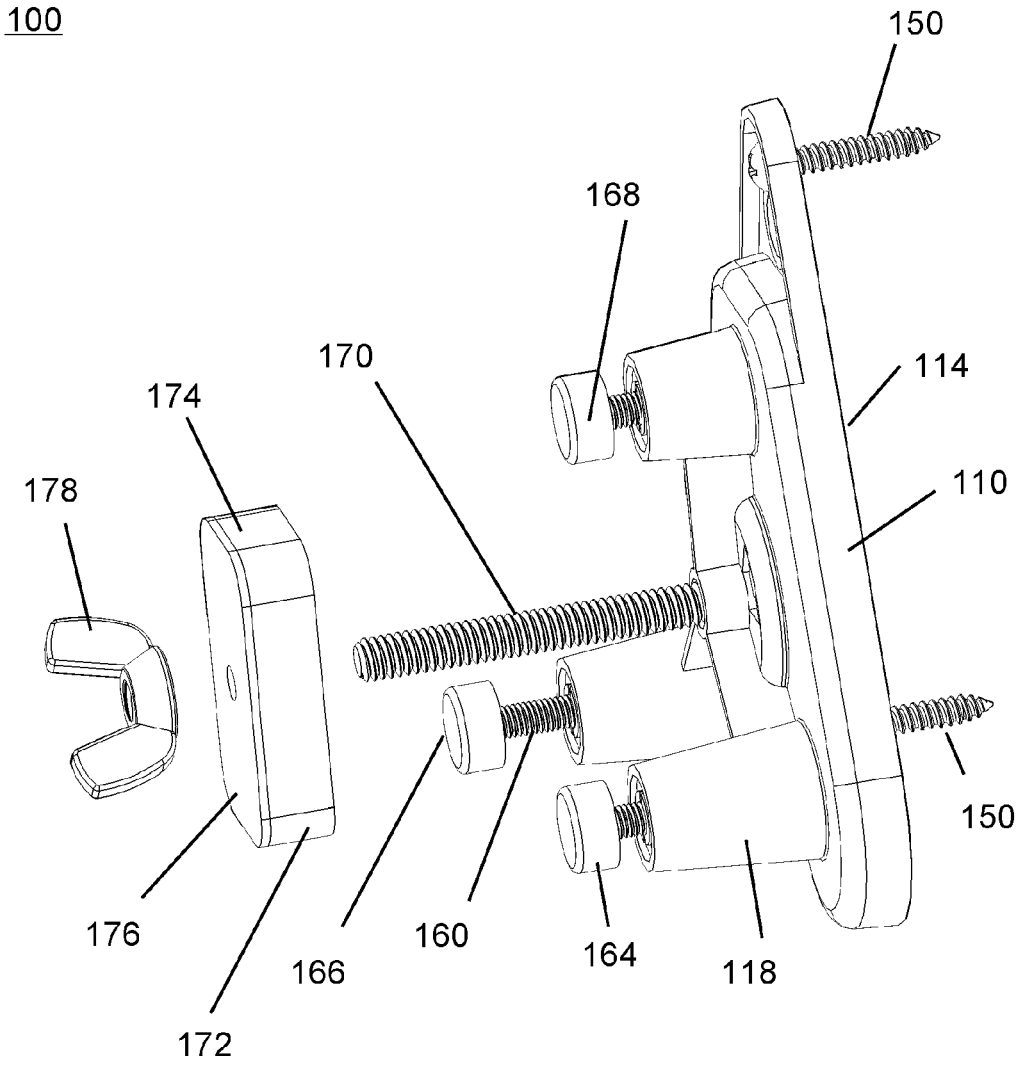
FIG. 1 is a side front perspective view of a helmet mount assembly.

For a variety of reasons, a person may wish to display a helmet on a wall much as one might want to display a football, basketball, or other item. The helmet may have been a helmet once worn by a person in the household when playing on a sports team. The helmet may be of the type worn by a favorite college or professional sports team. The helmet may be a commemorative helmet that is meant solely for display and would not be effective as a protective device.

While the size and shape of footballs and basketballs for use in certain leagues are highly standardized, this is not necessarily true for helmets within an application. For example not all football helmets have the same outer shape or ear hole.

While a traditional football helmet had a round ear hole on the right and left side of the helmet, there are a number of new designs for football helmets that have different shapes for the ear holes and have additional ridges on the outside of the helmet. To illustrate the point, one can visit As part of a non-limiting example, one can see the differences in various helmet designs at Wikipedia—https://en.wikipedia.org/wiki/Football_helmet#onebarfacemasks Riddell—http://www.riddell.com/shop/on-field-equipment/helmets.html Schutt Sports—http://www.schuttsports.com/

In addition to the range of shapes within football helmets, there are other helmets that may be the subject of display including helmets worn by baseball or softball players while at bat, helmets worn by ice hockey goalies or other ice hockey players, helmets worn while playing lacrosse, or any other helmet with at least one hole in the helmet to allow the helmet to be engaged with a mounting assembly using the teachings set forth below.

While a common use for the teachings of the present disclosure is to display a sport helmet, the teachings of the present disclosure are not limited to the display of sports helmets. Other helmets for various occupations or military uses that have an appropriate opening in the helmet may be displayed.

In the disclosure below and the claims, there is need to reference an opening in the helmet for engagement with the wall mount assembly. For clarity, the helmet opening is something other than the helmet primary cavity in the concave helmet shell for receipt of the head of the user to be protected. A helmet opening may be an ear hole, air vent, or other opening in the protective shell of the helmet. In some specialized applications such as aeronautics, the orientation of the airplane is described with respect to specific axes in terms of roll, pitch, and yaw.

In the present disclosure and in the claims that follow, tilt is used more generally to cover the angulation of the helmet with respect to the wall mount base or the wall generally. Thus, tilt is likely to include angulation with respect to more than one axes.

In the present disclosure and the claims that follow the orientation of the components are sometimes given as helmet side—the side closer to the helmet or wall side—the side closer to the wall. Depending on the slope and orientation of the wall, the helmet side may be to the right of wall side, to the left of wall side, below wall side, above wall side, or some combination of vertical and horizontal components if the wall is on an angle rather than vertical or horizontal. Likewise, elongated elements may have a helmet side end and a wall side end.

One Embodiment

With the various teachings of the present disclosure, the teachings of the present disclosure may be implemented in a variety of embodiments. In order to efficiently introduce concepts in this disclosure, it is expedient to start with a detailed discussion of one embodiment and then describe alternatives afterwards.

As shown in FIG. 1, a helmet mount assembly 100 has a wall mount base 110 that may be attached to the wall by one or more wall mount fasteners 150. One of skill in the art will recognize that there are many types of fasteners that may be used including screws, molly fasteners or other hollow wall fasteners, and even nails could be used. Amongst screws there are a variety of heads and driver engagement sections that may be used.

The helmet threaded element 170 protrudes from the wall mount base 110 through an opening on the helmet, through a pad 174, and engages a threaded bore in an interior threaded element 178 such as a wingnut. Other interior threaded elements could be used such as a nut and a washer. The pad 174 may have a soft section 172 that will be compliant with any ridges on the interior of the helmet and a washer board section 176 that allows the interior threaded element 178 to operate without damage to the pad 174. One of skill in the art will recognize that the interior threaded element 178 may be rotated relative to the helmet threaded element 170 to move the pad 174 towards the wall mount base 110.

Thus the interaction of the helmet threaded element 170 and the interior threaded element 178 can be used to pull the helmet towards the wall mount base 110.

A set of at least two wall mount pads 164, 166, 168 resists the movement of the helmet towards the wall mount base 110. When appropriately installed, the set of at least two wall mount pads 164, 166, 168 push out from the wall mount base 110 and the pad 174 pushes the helmet towards the wall mount base 110 so that the helmet is sandwiched in position.

The height of the wall mount pads 164, 166, 168 relative to the wall side 114 of the wall mount base 110 may be adjusted by rotating threaded elements 160 relative to wells 118 in the wall mount base 110. The rotation may be achieved by rotating the wall mount pads 164, 166, 168 or by removing the wall mount pads 164, 166, 168 and rotating the threaded elements 160 using a tool such as a screw driver or wrench.

Note that the wells 118 could be simply threaded bores placed in a sufficiently thick wall mount base.

The well 118 for upper wall mount pad 168 is shorter than the wells 118 for the lower wall mount pads 164 and 166 as many football helmets curve outward above the ear hole. A wall mount assembly 100 may have wells 118 that are all the same height or have some other relationship.

Figure 2:
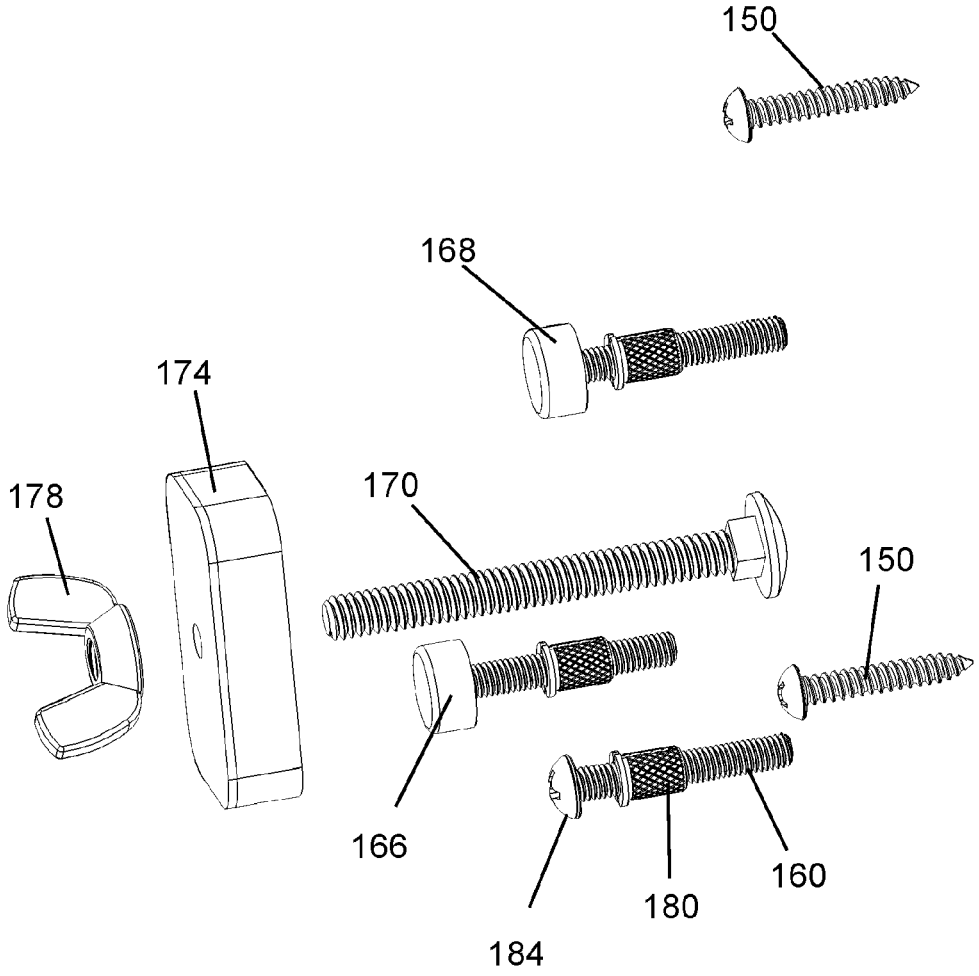
FIG. 2 is the same view of the wall mount assembly as shown in FIG. 1 but with the wall mount base 110 rendered invisible.

FIG. 2 is the same view of the wall mount assembly 100 as shown in FIG. 1 but with the wall mount base 110 rendered invisible. In FIG. 2 one can see that helmet threaded element 170 is a carriage bolt which has the advantage of not spinning within the wall mount base 110.

Wall mount pad 164 is rendered invisible to allow the head 184 of threaded element 160 to be seen. Head 184 is a round head. Those of skill in the art understand that there are a number of other screw heads with curved surfaces such as pan, dome (button), and truss (mushroom). It can be advantageous to have a screw head which allows the wall mount pads 164, 166, and 168 to tilt slightly to afford further adjustability relative to the surface of the helmet. Alternatively, the wall mount pads 164, 166, and 168 may be oversized and malleable. Another alternative would be to provide a connection between the wall mount pads 164, 166, and 168 and their respective threaded elements 160 which allows some degree of angulation between the wall mount pads 164, 166, and 168 and the threaded elements 160. Thus, the wall mount pads may be connected to the threaded element by a ball and socket joint or other joint providing at least one degree of freedom for movement between the wall mount pad and the threaded element.

FIG. 2 reveals that the wells 118 may not be threaded but may simply contain threaded inserts 180.

Figure 3:
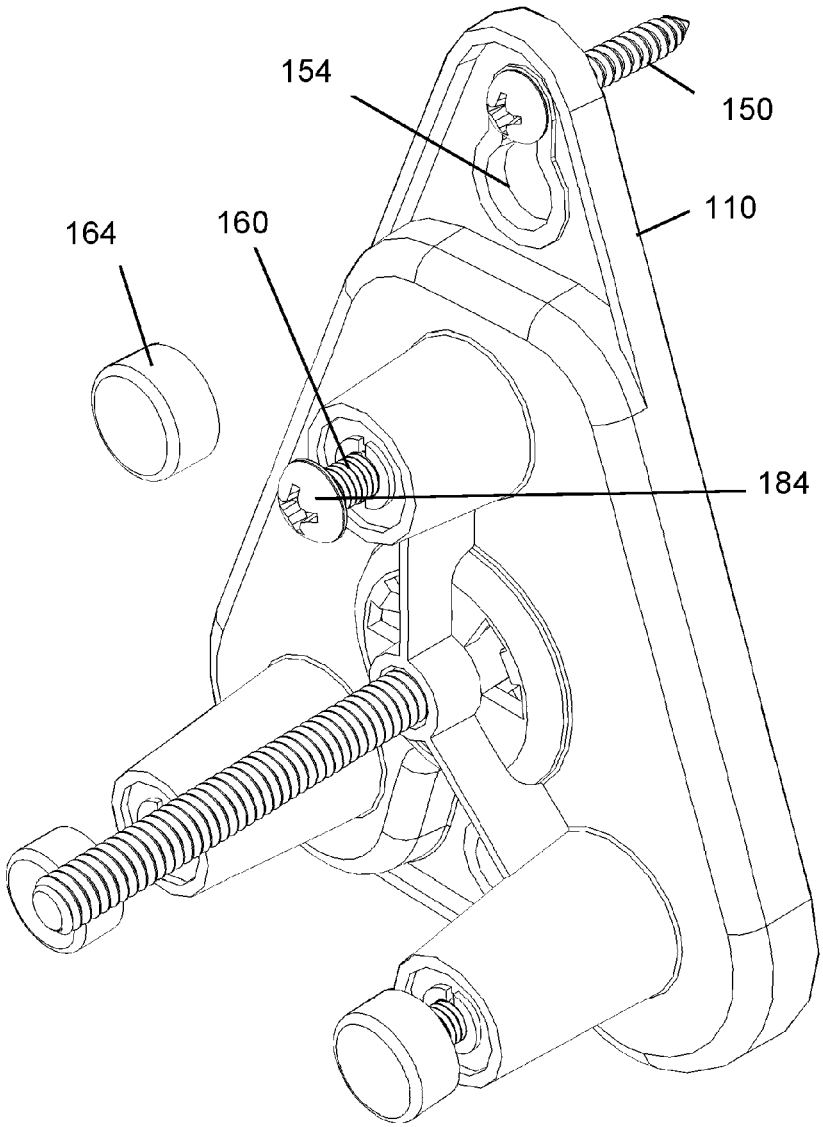
FIG. 3 is a front right top perspective view of the wall mount assembly with the pad rendered invisible.

FIG. 3 is a front right top perspective view of the wall mount assembly 100 with the pad (See FIG. 2 pad 174) rendered invisible. The top wall mount fastener 150 is visible engaged with a standard keyhole opening 154. While the example embodiment shows two wall mount fasteners 150, there may be one or more wall mount fasteners 150.

Wall mount pad 164 has been removed from the head 184 of the threaded element 160 so that an appropriate driver head may engage with the head 184 to rotate the threaded element 160 to change the spacing of the wall mount pad 164 (when replaced over the head 184) from the wall. While a Phillips head connection is shown on head 184, one of skill in the art will recognize that any female connector could be used including the non-limiting examples of: slot, Robertson (square), hex (Allen wrench), and Torx. Alternatively, the head could be a male head that is driven by a corresponding female socket or a wrench. A common example is a hex head which may be driven by a socket wrench or an adjustable wrench. The teachings of the present disclosure do not require a particular thread type or handedness.

While the example shown in FIG. 3 adjusts the height of a particular wall mount pad 164 by removing the wall mount pad 164 and using a tool to engage a head 184, this is not required. The threaded element 160 may be rotated relative to the relevant well 188 by engaging with a portion of the exposed threaded element 160, by rotating the wall mount pad 164 which in turn rotates the head 184 or by engaging with a rear head (not shown) on the threaded element 160 which is accessed from the wall side of the wall mount base 110.

The wall mount pads 164, 166, and 168 may be made of a material such as nylon that is softer than the outer shell of the helmet to be displayed so that contact between the wall mount pads 164, 166, and 168 and the helmet are unlikely to scratch or otherwise damage the helmet.

Appendix A shows the wall mount base 110 from a series of vantage points both with and without the threaded elements that are associated with the wall mount base 110.

Process of Mounting a Helmet onto a Wall.

FIG. 4 is a flowchart of one process 1000 to mount a helmet to a wall.

1010—Obtain a Helmet to be Displayed.

1020—Select the Location on the Wall.

1030—Install Wall Mount Fasteners. Install set of wall mount fasteners 150 into the wall with the heads left a distance from the wall so that there is room for the wall mount assembly 100 to be held to the wall by the wall side of the heads of the wall mount fasteners 150. If installed into drywall, then drywall anchors may be used. An appropriate size dry wall anchor may be selected and an appropriate size pilot hole placed into the drywall to receive the dry wall anchor. A stud sensor may be used to engage wooden studs instead of using drywall anchors. An appropriate size drill bit may be used to drill a pilot hole into the stud to receive the wall mount fastener. The engagement between the wall mount base 110 and the wall mount fasteners 150 may be the standard keyhole engagement where the head of the wall mount fastener 150 fits through a larger lower section of the key hole and the wall mount base 110 is retained when the wall mount base 110 is allowed to move downward so that the wall mount fastener 150 is now in a smaller upper section that is smaller than the wall mount fastener head.

1040—Adjust Wall Mount Pads. Optionally, the heights of the wall mount pads 164 may be set to initial estimates before the wall mount base 110 is engaged with the wall mount fasteners 150. This step is optional as the wall mount base 110 may be engaged with the wall mount fastener 150 before making any adjustments to the wall mount pads 164, 166, 168.

Adjust the heights of the array of two or more wall mount pads 164 to accommodate the shape of the helmet to be mounted and any desired angulation of the helmet to provide a particular tilt of the helmet. For example, if the helmet is to be mounted well above eye-level, then the upper one or more wall mount pads may be extended outward to tilt the upper portion of the helmet outward so that the upper portion of the helmet is easier to see. Alternatively, a helmet placed at near eye-level may have adjustments to the heights of the wall mount pads to rotate the face mask outward from the wall. The helmet orientation relative to the wall may be adjusted to facilitate viewing of a signature or other item of interest. Note that if there is only one fixed height wall mount pad and one adjustable height wall mount pad, that this process would simply Adjust Wall Mount Pad (singular).

1050—Engage Wall Mount Base with Wall Mount Fasteners.

1060—Insert Threaded Element Through Helmet Opening. Insert the helmet threaded element 170 through the relevant opening in the helmet. Typically, this would be an opening near the ear of an intended user of the helmet, but the relevant opening could be another opening. Some helmets have two openings, one on either side of the helmet over the ears. Other helmets have a number of openings for ventilation or other purposes. Typically the opening would be on a side of the helmet so that the mounted helmet is viewed in profile but this is not required.

Many helmets have ear holes on the sides of the helmet plus some vent holes. These helmets allow for a range of mounting options as the opening used to engage with the wall mount assembly may be towards the front of the helmet, on the side, or in the back of the helmet. The opening used to engage with the wall mount assembly may be near the bottom portions of the helmet or may be towards the upper portions of the helmet. The ability to select one of several openings in a helmet and vary the tilt of the helmet relative to the wall mount assembly allows for a broad set of orientations of a mounted helmet with respect to the wall.

In some instances, a user may choose to engage the helmet to the wall mount assembly though a hole in the face mask portion of the helmet. This selection might be useful if there was an autograph on the rear surfaces of a helmet or if a series of helmets were displayed in order to show the helmet from a number of viewing angles.

Note, the wall mount assembly 100 may be shipped with the pad 174 and interior threaded element 178 engaged with the helmet threaded element 170. If so, then the interior threaded element 178 and pad 174 would be removed prior to this step.

1070—Check Helmet Tilt on Wall Mount Pads. After step 1060, the helmet may be pressed against the array of wall mount pads to check if the tilt of the helmet is acceptable for the intended viewing effect.

1080—Adjust Wall Mount Pads if Desired. After checking tilt, make adjustments to the wall mount pad heights as desired. As noted above, this may involve removing the wall mount pad 164 from the head 184 of the threaded element 160, rotating the head 184 to adjust the height of the wall mount pad 164 relative to the wall and then covering the head 184 with the wall mount pad 164. The heights of the other wall mount pads (166, 168) may be adjusted as well. Differences of the relative heights of the wall mount pads 164, 166, 168 will allow the helmet to be titled relative to the wall mount base 110. At least one of the wall mount pads may be set a fixed height from the wall mount base 110 as movement of the one or more non-fixed wall mount pads will allow the helmet to be tilted.

1090—Engage Pad with the Helmet Threaded Element. When ready to hold the helmet to the wall mount base 110, a pad 174 is placed over the helmet so that the helmet threaded element now passes through the relevant hole in the helmet and a bore in the pad 174 so that a portion of the helmet near the relevant hole is located between the pad 174 and the wall mount base 110.

1100—Advance the Interior Threaded Element. More specifically, advancing the interior threaded element 178 along the helmet threaded element 170 towards the wall mount base 110. The movement of the interior threaded element 178 towards the wall mount base 110 moves the engaged helmet to push the helmet firmly against the wall mount pads 164, 166, 168.

If not totally satisfied with the orientation of the helmet, remove interior threaded element 178 to allow the pad 174 to be removed and the helmet disengaged from the helmet threaded element 170. The user may then further adjust the wall mount pad heights as desired before re-engaging the pad 174 and advancing the interior threaded element 178. The final result is a helmet that appears to float next to the wall when viewed by a viewer positioned so that the helmet is located between the viewer and the wall mount base 110.

Alternatives and Variations.

Alternative Mounting Sequence.

One of skill in the art will recognize that the sequence of mounting the wall mount base 110 to the wall before engaging the helmet with the wall mount base 110 could be changed if a user prefers to engage the helmet with the wall mount base 110 before hanging the wall mount base 110 with the engaged helmet with the previously placed wall mount fasteners 150 through a keyhole opening 154 in the wall mount base 110.

When using this alternative sequence, a user may wish to have the wall mount base on a horizontal surface such as a table when making adjustments of the helmet to the wall mount base 110.

Keyhole Connection Not Required.

While a keyhole opening 154 is one viable solution attaching a wall mount base 110 to a wall, it is not mandatory for use of the various teachings of the present disclosure. One could simply have openings in the wall mount base 110 that are sized so that the shank of the wall mount fastener 150 may pass through the hole to allow the head of the wall mount fastener 150 to press the wall mount base 110 against the wall.

Pad with Integral Threaded Element.

One of skill in the art will recognize that the two pieces inside the helmet (pad 174 and interior threaded element 178) could be one element that serves as the pad but has a threaded bore possibly through the use of a threaded insert. Alternatively, the bore through the washer board section 176 of the pad 174 could be threaded. In either event, the interior threaded element is an integral part of the pad. Conversely, an interior threaded element 178 such as a wingnut may have a sufficiently large washer affixed to the wall side of the interior threaded element to serve the function of the pad to hold the helmet between the pad and the wall mount pads.

One of skill in the art will recognize that it may be desirable on some helmets with soft padding near the helmet hole that receives the helmet threaded element 170 to use a pad 174 with a separate interior threaded element 178 so that the pad 174 may have a soft side facing the soft interior of the helmet and may remain immobile while the interior threaded element 178 is advanced. For other helmets, it is possible that the inside of the helmet near the hole in the helmet that receives the helmet threaded element 170 may be tolerant of a wingnut with integral washer that rotates relative to an interior surface of the helmet.

Use a Male Threaded Element Protruding from Inside the Helmet.

One of skill in the art can appreciate that helmet threaded element 170 extending from the wall mount base 110 could be replaced with a threaded tube or bore (not shown). The bore may be threaded by the inclusion of a threaded insert as shown in FIG. 2. A threaded element engaged with the pad 174 could be extended through an appropriate hole in the helmet to engage the threaded tube. The threaded tube should be sufficiently short that the helmet can be advanced towards the wall mount base 110 an adequate distance to firmly hold the helmet between the pad 174 and the wall mount pads (164, 166, and 168).

FIG. 5 illustrates a well 218 which may have a threaded insert 280 or be threaded without an insert. The well 218 forms a female helmet threaded element with an open threaded bore. The pad 174 may have distinct sections of a soft section 172 and washer board section 176. The male interior threaded element 278 may have a head 284 as shown here in the form of a round head with a recess to receive Phillips head screw driver tip. The head 284 of the male interior threaded element 278 could be any known head that may be engaged with a male or female driver. Alternatively, the head of the may be a wingnut or another head that facilitates adjustment by hand without the use of a tool.

Use of Other Pad Shapes.

The pad 174 shown in FIG. 1 and FIG. 2 is a rectangular pad with rounded corners. Other pad shapes may be used. The shape may be triangular as show below or it may be circular, oval, or any other shape. There is not a requirement that the pad 174 have a soft section 172 that is the same size and shape as the washer board section 176 that allows the interior threaded element 178 to operate without damage to the pad 174.

Use of a Fixed Height Wall Mount Pad.

While the example set forth above has the ability to adjust the height of all the wall mount pads, one of skill in the art will appreciate that one wall mount pad could have a fixed height. The ability to adjust the other wall mount pad heights should allow adjustment for helmet shape and ability to provide angulation.

Use of Different Length Threaded Elements.

One of skill in the art will appreciate that for a severe helmet shape or desired angulation, it may be necessary to use a set of threaded elements of different lengths.

Kits.

The wall mount assemblies may be sold and used to mount and display a helmet previously acquired. Alternatively, the wall mount assembly may be provided with a helmet as part of a kit that includes both the helmet to be displayed and a wall mount assembly.

Use of Other Adjustments for Wall Mount Pad Heights.

Those of skill in the art will see the teachings of the present disclosure and recognize that a set of wall mount pad heights may be varied using other tools known in the art. These tools include using a non-threaded rod in a sleeve and fixing the relative positions using a set screw. The wall mount pad height may be varied at least in part by using pads of different thicknesses. Other tools exist to allow one to set an array of wall mount pad heights to accommodate the shape of the helmet and the desired angulation.

With an appropriate choice for the process to alter the height of a wall mount pad relative to the wall, it may be possible to make the adjustments while the interior threaded element 178 is engaged with the helmet threaded element 170 with an engaged helmet. For example, a user may be able to rotate a threaded element 160 directly with the use of the user's fingers, through user rotation of the wall mount pad 164 while the wall mount pad 164 is attached to the threaded element, or through use of a fixed or removable piece that extends laterally from the threaded element. One example is a wrench that engages a hexagonal portion of the threaded element close to the wall mount pad 164.

If the heights of the wall mount pads are adjusted by a adjusting a head accessible on the wall side of the wall mount base 110 when the wall mount base 110 is not hanging on the wall, then the helmet may not need to be disengaged with the helmet threaded element 170 to make height adjustments to adjust the tilt of the helmet.

One of skill in the art will recognize that some of the alternative implementations set forth above are not universally mutually exclusive and that in some cases additional implementations can be created that employ aspects of two or more of the variations described above. Likewise, the present disclosure is not limited to the specific examples or particular embodiments provided to promote understanding of the various teachings of the present disclosure. Moreover, the scope of the claims which follow covers the range of variations, modifications, and substitutes for the components described herein as would be known to those of skill in the art.

What is claimed is:

1. A helmet mount assembly for holding a helmet in a fixed relationship relative to a wall mount base, the helmet mount assembly comprising:

the wall mount base;

a pad; and an interior threaded element;

the wall mount base comprising:

a set of at least two wall mount pads which resist movement of the helmet towards the wall mount base, at least one of the set of at least two wall mount pads being adjustable to alter a distance between a helmet side of the wall mount pad and a wall side of the wall mount base; and a helmet threaded element that protrudes from the wall mount base away from the wall side of the wall mount base;

the pad comprising:

a bore to receive the helmet threaded element;

wherein:

placing a helmet such that the helmet threaded element extends into a helmet primary cavity through an opening in the helmet allows the bore of the pad to be placed over the helmet threaded element; and advancing the interior threaded element holds the helmet between the pad and the set of at least two wall mount pads to display the helmet at a selected tilt with respect to the wall mount base.

2. The helmet mount assembly of claim 1 wherein all of the set of at least two wall mount pads are adjustable to alter a distance between the helmet side of the wall mount pad and the wall side of the wall mount base.

3. The helmet mount assembly of claim 1 wherein one of the set of at least two wall mount pads is not adjustable to alter a distance between the helmet side of the wall mount pad and the wall side of the wall mount base.

4. The helmet mount assembly of claim 1 wherein the distance between the helmet side of a particular wall mount pad the wall side of the wall mount base is adjusted from the helmet side of the wall mount base.

5. The helmet mount assembly of claim 1 wherein at least one wall mount pad is removable from a threaded element with a head; and the distance between the helmet side of a particular wall mount pad and the wall side of the wall mount base is adjusted by engaging a tool with the head and rotating the threaded element then placing the wall mount pad upon the head of the threaded element.

6. The helmet mount assembly of claim 1 wherein the distance between the helmet side of a particular wall mount pad and the wall side of the wall mount base is adjusted from the wall side of the wall mount base.

7. The helmet mount assembly of claim 1 wherein the interior threaded element is an integral part of the pad.

8. The helmet mount assembly of claim 1 wherein the pad is an integral part of the interior threaded element.

9. The helmet mount assembly of claim 1 further comprising at least one helmet for holding in a fixed relationship relative to a wall mount base.

10. A helmet mount assembly for holding a helmet in a fixed relationship relative to a wall mount base, the helmet mount assembly comprising:

the wall mount base;

a pad; and an interior threaded element;

the wall mount base comprising:

a set of at least two wall mount pads which resist movement of the helmet towards the wall mount base, at least one of the set of at least two wall mount pads being adjustable to alter a distance between a helmet side of the wall mount pad and a wall side of the wall mount base; and a female helmet threaded element open on a helmet side of the wall mount base to engage the interior threaded element;

the pad comprising:

a bore to receive the interior threaded element;

wherein:

placing a helmet such that the interior threaded element extends through a bore in the pad and from a helmet primary cavity through an opening in the helmet; and advancing the interior threaded element into the female helmet threaded element holds the helmet between the pad and the set of at least two wall mount pads to display the helmet at a selected tilt with respect to the wall mount base.

11. The helmet mount assembly of claim 10 further comprising at least one helmet for holding in a fixed relationship relative to a wall mount base.

* * * * *